US006559583B1

(12) United States Patent
Kanayama et al.

(10) Patent No.: US 6,559,583 B1
(45) Date of Patent: May 6, 2003

(54) SHADOW MASK

(75) Inventors: Nobuaki Kanayama, Tokyo-to (JP); Takahito Aoki, Tokyo-to (JP); Yutaka Matsumoto, Tokyo-to (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 34 days.

(21) Appl. No.: 09/698,578

(22) Filed: Oct. 27, 2000

(30) Foreign Application Priority Data

Oct. 29, 1999 (JP) ..... 11-310063

(51) Int. Cl.[7] ..... H01J 29/07
(52) U.S. Cl. ..... 313/402
(58) Field of Search ..... 313/402, 403, 313/404, 405, 407, 408

(56) References Cited

U.S. PATENT DOCUMENTS 4,724,012 A * 2/1988 Inaba et al. ..... 148/2
5,308,723 A * 5/1994 Inoue et al. ..... 430/23
5,605,582 A * 2/1997 Inoue et al. ..... 148/320
6,165,640 A * 12/2000 Sugikawa ..... 429/166
2002/0006350 A1 * 1/2002 Nishida et al. ..... 420/94
2002/0015655 A1 * 2/2002 Suzuki et al. ..... 420/46
2002/0033207 A1 * 3/2002 Fukuda et al. ..... 148/120

FOREIGN PATENT DOCUMENTS

JP 61186452 * 8/1986
JP 4358042 * 12/1992

* cited by examiner

*Primary Examiner*—Ashok Patel
(74) *Attorney, Agent, or Firm*—Timothy J. Keefer; Wildman, Harrold, Allen & Dixon

(57) ABSTRACT

A shadow mask is composed of an iron-based alloy plate containing 31.0–38.0 weight % of nickel and 1.0–6.5 weight % of cobalt. The iron-based alloy has a crystal grain size number of 10 or more and 12 or less, has a crystal grain size of 50 $\mu$m or less in a cross section in a direction parallel and normal to a rolling direction of the iron-based alloy plate, and has an average crystal grain size of 30 $\mu$m or less in a cross section in a direction parallel to the rolling direction of the iron-based alloy plate.

3 Claims, 2 Drawing Sheets

SHADOW MASK

This application claims the priority of Japanese patent application Serial No. 11-310063 filed on Oct. 29, 1999.

BACKGROUND OF THE INVENTION

The present invention relates to a shadow mask to be usable for high-definition color Braun tubes (cathode ray tubes) such as color television display, computer display or the like, and more particularly, to a shadow mask which is free from color mismatching to be caused by thermal expansion of the shadow mask and has an excellent accuracy in dimension of an opening portion (aperture).

Conventionally, a shadow mask has been used for color Braun tubes such as color television display, computer display or the like. The shadow mask is located to a predetermined portion in the color Braun tube and comprises opening portions through which electron beam is radiated to a fluorescent material layer (phosphor layer) formed to an inner surface of the Braun tube.

The shadow mask takes various structures for the opening portions so that:

(a) a number of small and round through holes (circular apertures) are formed;

(b) a number of small through holes (apertures) each having a rectangular-shape are formed; and (c) a number of slits are provided so as to align with each other.

The shadow masks formed with the opening portions having structures specified in (a) and (b) are hereinlater referred to as "press-type shadow mask" for the sake of convenience and usually manufactured by press-molding (forming) method so as to match with an inner shape of the Braun tube. On the other hand, the shadow mask formed with the opening portion having a structure specified in (c) is hereinlater referred to as "expansion-type shadow mask" for the sake of convenience and is called an aperture grill. The expansion-type shadow mask is usually manufactured by fixing a mask body to a rigid steel frame while the slits are expanded in a longitudinal direction thereof.

As shown in FIG. 2, the through holes and slits are generally formed by simultaneously etching both surfaces of a mask plate member, and each of the through holes consists of a small hole portion (aperture) 4 formed to one side 2 of the mask plate member to which electron beam incidents and a large hole portion 6 formed to the other side opposing to a side of a fluorescent surface formed to the inside of the Braun tube. A diameter of the through hole or width of the slit through which the electron beam passes is determined by the small hole portion 4, the large hole portion 5 and an intersecting portion of both the small and large hole portions.

In the Braun tube comprising the shadow mask, a part of electron beams radiated from an electron gun collide with a surface of the shadow mask without passing through the through holes and the slits. Therefore, the shadow mask is heated through the collision of the electron beams.

In this regard, since the conventional shadow mask is formed of a low-carbon steel plate having a large thermal expansion coefficient, the shadow mask is liable to cause thermal expansion due to the heat generation based on the collision of the electron beams. Accordingly, there has been caused phenomena such that a displacement and deformation of the through holes are disadvantageously caused and slacks are arisen at the slit-portions to thereby cause the disturbance in slit interval.

Such phenomena lead to the displacement of the electron beams to be attained to the fluorescent material layer (phosphor layer) formed inside the Braun tube, so that there has been posed a problem such that color mismatching is caused in an image reproduced on the Braun tube.

In particular, in these days, a color television set and computer display unit or the like have been required to display an image having a high resolution, so that it has been also required for the shadow mask to decrease a pitch of the through hole or the slit. However, such demand has not been attained up to now, and there is a fear that the above color mismatching in the image based on the thermal expansion will be more remarkable.

To cope with these problems, for the purpose of suppressing the thermal expansion of the metal material, it has been tried to use a metal material having a small thermal expansion coefficient. For example, some of the shadow masks are formed by using iron-nickel alloy or iron-nickel-cobalt alloy. Such shadow masks have an advantage of that the thermal expansion hardly occurs even if the heat generation is took place by the collision of the electron beams.

However, inherently, the iron-nickel alloy plate and the iron-nickel-cobalt alloy plate have a relatively large crystal grain in comparison with that of a conventional low-carbon steel plate which has been widely used for the alloy plate. Accordingly, there has been posed a problem such that it was difficult to smoothly perform an etching treatment for the alloy plate so as to obtain a fine through hole or slit excellent in the dimensional accuracy.

In such the etching treatment, the etching function of forming the through hole or the slit progresses simultaneously not only in a depth (thickness) direction of the alloy plate but also in a width (longitudinal or lateral) direction of a plate member. In particular, in a case where the etching function easily progresses, the small hole portion and the large hole portion each having an excessively large size are disadvantageously formed, so that the respectively adjacent through holes or slits are joined together at the large hole portions. Therefore, it was very difficult to decrease the pitch between the adjacent opening holes. Accordingly, there was a fear such that it was difficult to manufacture a shadow mask having a reduced pitch required for finely forming the adjacent opening holes. In addition, since a hole diameter of the large hole portion becomes excessively large, there was a fear that the strength of the shadow mask itself becomes lowered, thus being disadvantageous.

Further, there was also a fear that the lowering of the strength of the shadow mask itself based on the excessive progressing of the etching function would induce a deformation of a shape of the shadow mask through impacts, shocks or vibrations that were inevitably caused at the time when the shadow mask was transferred during the manufacturing process thereof or the shadow mask was attached to the Braun tube, and further, the Braun tube was transferred or transported.

In particular, in the case of a shadow mask for a large-sized display type or a flat-type Braun tube, it was required to form a large hole portion having a large size so as to reduce the pitch of the through hole or the slit and so as not to obstruct the passing through of the electron beam, thus providing a problem that it was difficult to manufacture a shadow mask excellent in the dimensional accuracy and a problem that the deformation was liable to cause due to the lowering of the strength of the shadow mask.

To cope with the above problems, there has been adopted a method in which a shadow mask excellent in the dimensional accuracy of the through hole or slit is obtained by reducing a crystal grain size in a metal material for making a wall surface of the opening portion smooth after the completion of the etching treatment.

However, when the crystal grain size in the metal material is reduced, an etching speed is disadvantageously lowered, thus also providing a problem that a longer time for performing the etching treatment is required than that in the case of using the conventional low-carbon steel plate.

In addition, there was also an actual situation that the through hole or slit is hardly formed so as to have a predetermined aimed shape even if only the crystal grain size is reduced. Particularly, in the case of a press-type shadow mask to which the through holes each having a complete round-shape are formed, there was posed a problem that the shape of the through hole is difficult to be formed so as to have a complete round shape.

As another countermeasure, there has been well known a shadow mask composed of an iron-nickel alloy plate in which a composition or surface cleanliness of a metal material is properly adjusted or a crystal face orientation of the metal material is controlled to a specific direction. However, any of the above countermeasures has not attained to a level capable of solving the problems mentioned above.

SUMMARY OF THE INVENTION

An object of the present invention is to substantially eliminate defects or drawbacks encountered in the prior art mentioned above and to provide a shadow mask for a color Braun tube capable of preventing a diameter of a large hole portion from being excessively enlarged by improving a hole shape of an opening portion.

This and other objects can be achieved according to the present invention by providing a shadow mask composed of an iron-based alloy plate containing 31.0–38.0 weight % of nickel and 1.0–6.5 weight % of cobalt, wherein the iron-based alloy has a crystal grain size number of 10 or more and 12 or less, has a crystal grain size of 50 $\mu$m or less in a cross section in a direction parallel and normal to a rolling direction of the iron-based alloy plate, and has an average crystal grain size of 30 $\mu$m or less in a cross section in a direction parallel to the rolling direction of the iron-based alloy plate.

The iron-based alloy has a thermal expansion coefficient of approximately $4.0\times10^{-6}$/° C.

More in detail, there is provided a shadow mask for a Braun tube comprising:

a frame member;

a mask body in shape of plate made of an iron-based alloy material; and an opening portion formed to the mask body, wherein the iron-based alloy material contains 31.0–38.0 weight % of nickel and 1.0–6.5 weight % of cobalt, the iron-based alloy has a crystal grain size number of 10 or more and 12 or less, has a crystal grain size of 50 $\mu$m or less in a cross section in a direction parallel and normal to a rolling direction of the iron-based alloy, and has an average crystal grain size of 30 $\mu$m or less in a cross section in a direction parallel to the rolling direction of the iron-based alloy.

According to the present invention of the characters mentioned above, since the iron-based alloy plate containing 31.0–38.0 weight % of nickel and 1.0–6.5 weight % of cobalt has a crystal grain size number of 10 or more and 12 or less, and the iron-based alloy is composed of fine crystal grains by specifying the crystal grain size so as to have a crystal grain size of 50 $\mu$m or less in a cross section in a direction parallel and normal to a rolling direction of the iron-based alloy plate and an average crystal grain size of 30 $\mu$m or less in a cross section in a direction parallel to the rolling direction of the iron-based alloy plate, so that an etching treatment can be performed with a high accuracy at the time of manufacturing the shadow mask.

As a result, a shadow mask being free from unevenness and having an improved shape, of the opening portion for a color Braun tube can be effectively manufactured. In addition, it becomes possible to prevent the large hole portion from being excessively etched, so that the reduction of pitch for providing the opening holes in accordance with a trend toward high definition can be realized, and the lowering the strength of the shadow mask can be prevented. A Braun tube provided with the shadow mask of the present invention can sufficiently cope with the trend toward a high-definition, a quality of an image reproduced on a television can be further improved.

The nature and further characteristic features of the present invention will be made more clear from the following descriptions made with reference to the accompanying drawings.

DESCRIPTION OF THE PREFERRED EMBODIMENT

Figure 1:
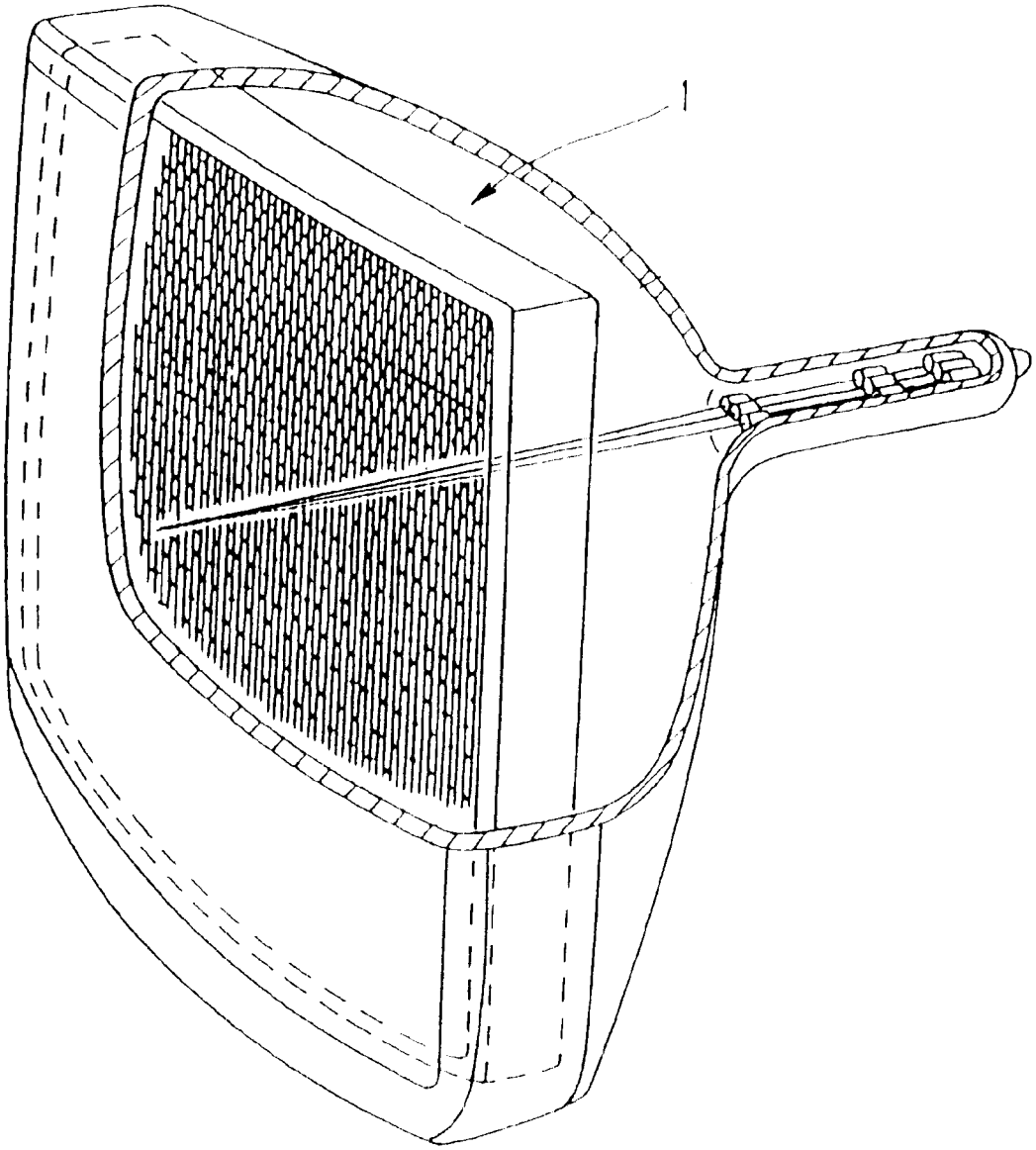
FIG. 1 is a perspective view showing one embodiment of a shadow mask according to the present invention which is applied to a color Braun tube.

Referring to FIG. 1, preferred embodiments of the shadow mask 1 for a color Braun tube according to the present invention will be explained hereunder with reference to the accompanying drawings. In the explanations made hereunder, unless otherwise specifically noted, a unit symbol of "%" representing the unit in composition means weight % (wt %), which is equal to mass %.

The shadow mask of the present invention is composed of an iron-based alloy plate containing 31.0–38.0 weight % of nickel and 1.0–6.5 weight % of cobalt. Further, the iron-based alloy plate has a crystal grain size number of 10 or more and 12 or less, wherein the iron-based alloy plate has a crystal grain size of 50 $\mu$m or less in a cross section in a direction parallel and normal to a rolling direction of the iron-based alloy plate, while having an average crystal grain size of 30 $\mu$m or less in a cross section in a direction parallel to the rolling direction of the iron-based alloy plate.

At first, a composition of the iron-based alloy plate will be explained. The iron-based alloy plate containing the above components within the alloy composition is a metal material having a low thermal expansion coefficient of about $4.0–10^{-6}$/° C. Further, when an optimum thermal expansion coefficient is taken into consideration, more preferable composition ranges of the components are 32.0–34.0 wt % of nickel and 3.5–6.5 wt % of cobalt. Thus resulting into a thermal expansion coefficient of $1.0\times10^{-6}$/° C. or less.

In the case where the nickel content is less than 31.0 wt % or exceeds 38.0 wt %, the thermal expansion is liable to be caused by the heat generation through the collision of the electron beam, so that there may be posed a fear that displacement and deformation are liable to be caused at the through holes or slits formed to the shadow mask.

In addition, in the case where the cobalt content is less than 1.0 wt % or exceeds 6.5 wt %, as the same as above, the thermal expansion is liable to be caused by the heat generation based on the collision of the electron beam, so that there may also be posed a fear that the displacement and deformation are liable to be caused at the through holes or slits formed to the shadow mask to thereby raise a disturbance of the slit-interval.

The iron-based alloy plate contains unavoidable impurities that are mixed into the alloy plate during the manufacturing processes thereof. Further, as far as the contents of the components are within the range capable of achieving the object of the present invention, other components or elements such as silicon, manganese, phosphorus, sulfur, chromium, carbon or the like may be appropriately contained in the iron-based alloy plate for the purpose of exhibiting peculiar properties such as deoxidizing function, forging property or the like at the time of manufacturing the alloy plate.

Normally, examples of the alloy composition may include a composition containing 0.30 wt % or less of silicon, 0.60 wt % or less of manganese, 0.020 wt % or less of phosphorus, 0.020 wt % or less of sulfur, and balance of iron and unavoidable impurities. However, the composition of the iron-based alloy plate is not limited thereto.

Next, a crystal grain size of the iron-based alloy plate will be explained.

The inventor of the present invention paid his attention to a fact that the component of a metal material was mainly etched and removed along crystal grain boundaries, and the inventor obtained the following findings:

(i) when a metal material composed of large crystal grains was etched, an etching surface was waved or corrugated in accordance with the crystal grain size, whereby a smoothness of the etched surface was lost or deteriorated; and (ii) in a case where there exists anisotropy in crystal grain size of the alloy plate in directions between the thickness direction and the rolling direction or width direction of the alloy plate, there was a possibility of causing a phenomena that the etching function progressed with a priority in a rolling direction or width direction.

The present invention achieved in view of the above findings and by preventing the holes, especially, large hole portions from being excessively expanded.

Therefore, in the present invention, as a first countermeasure, a level of the crystal grain size number, i.e. average crystal grain size was specified so that an entire crystal grain size was suppressed to a small level. However, this countermeasure was insufficient in a case where crystal grains each having a large size separately existed in a metal structure.

Accordingly, as a second countermeasure, the alloy plate was manufactured so that the crystal grains each having a large size were not separately existed by specifying the crystal grain size i.e. a maximum grain size of the crystal grains to be revealed in a cross sectional surface in a direction parallel or normal to the rolling direction.

In addition, as a third countermeasure, for the purpose of eliminating the anisotropy in crystal grain size of the alloy plate in directions between the thickness direction and the rolling direction or width direction of the alloy plate, the average crystal grain size of the crystal grains to be revealed in a cross sectional surface in a direction parallel to the rolling direction was specified, thus, in such manner, achieving the object of the present invention.

The crystal grain size number was measured in accordance with a grain-size-number measuring method prescribed in JIS (Japanese Industrial Standard) G0551 equivalent to ASTM E112. The crystal grains constituting the iron-based alloy plate having a crystal grain size number specified as mentioned above are entirely formed to be fine, so that wall surfaces of the etched opening portions become smooth and the opening portions can be easily etched so as to form a predetermined shape.

When the crystal grain size number is less than 10, the crystal grains would have a relatively large size and the large-sized crystal grains are removed by the etching treatment, the etched surfaces are waved or corrugated in accordance with the size of the removed crystal grains, so that there is a fear that the smoothness of the etched surfaces is lost and it becomes difficult to accurately etch the iron plate so as to form the predetermined shape i.e. a complete circular-shape.

On the other hand, when the crystal grain size number exceeds 12, the crystal grains would have a small size, so that the etching speed is disadvantageously lowered and the etching operation requires a long period of time for obtaining the predetermined shape, thus being a cause of lowering a production efficiency.

In this connection, a preferable range of the crystal grain size number is 11 or more and 12 or less. The crystal grain size number of the iron-based alloy plate can be set and controlled to be within the above predetermined range by optimally combining various conditions such as a reduction (rolling) ratio in a cold-rolling process, an annealing temperature and time at an annealing process or the like that are suitably controlled in the manufacturing processes of the shadow mask as described later on.

The crystal grain size in a cross section in a direction parallel or normal to the rolling direction of the iron-based alloy plate was measured in accordance with a method shown in Examples described hereinlater. The crystal grain size defined in the present invention means a maximum crystal grain size of the crystal grains revealed on either a cross section in parallel to rolling direction or a cross section normal to the rolling direction.

In the present invention, the maximum crystal grain size of the crystal grains is also specified to the above range in addition to the specification of the crystal grain size number, so that the large-sized crystal grains in a form of separated-state can be eliminated and the smoothness of the etched wall surfaces of the opening portions can be further improved. Thus, it becomes more easy to etch the alloy plate to obtain a predetermined shape.

When the crystal grain size exceeds 50 $\mu$m, the large-sized crystal grains are separately existed, so that the shape of the wall surface of the opening portions is deteriorated even if the crystal grain size number is set to be within the above range. In addition, particularly, in the case of a press-type shadow mask, there may be a case where a circularity (roundness) of the through hole is deteriorated. A setting or controlling the crystal grain size can be performed in accordance with the same method as in the case of crystal grain size number as described above.

The average crystal grain size in a cross section in a direction parallel to the rolling direction of the iron-based alloy plate was measured in accordance with a method shown in Examples described hereinlater. The iron-based alloy having the average crystal grain size of the above range has not a remarkable anisotropy in the crystal grain size, so that the etching function would not progress with a priority in a rolling direction shown in FIG. 2. Therefore, the shape of the through hole or slit, particularly, the diameter of the large hole portion can be prevented from being excessively expanded. As a result, the alloy plate can be etched so as to form a predetermined shape.

Figure 2:
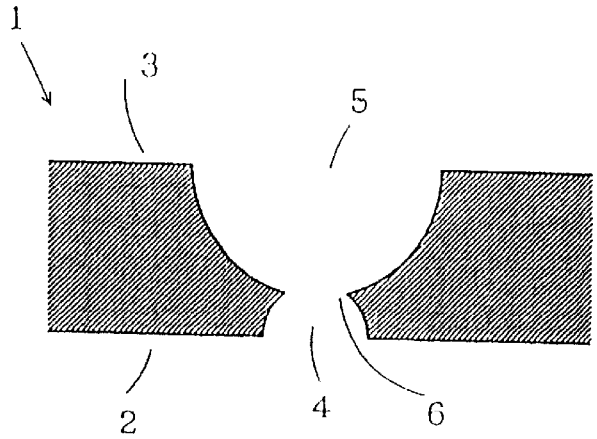
FIG. 2 is a schematic sectional view showing one example of a sectional shape of a through hole or slit formed to the shadow mask according to the present invention.

When the average crystal grain size exceeds 30 $\mu$m, a remarkable anisotropy in crystal grain size will reveal in the alloy plate, so that the etching function progresses with a priority in the rolling direction shown in FIG. 2, whereby there may cause a case of deteriorating the hole-shape of the opening portion.

In the present invention, the iron-based alloy plate to be used for the shadow mask is manufactured into a thin plate by a rolling process and the resulting crystal grains are generally elongated in a direction parallel to the rolling direction. Therefore, only the average crystal gram size in a cross section parallel to the rolling direction is specified in the present invention. A setting or controlling the average crystal grain size can be performed in accordance with the same method as in the case of the crystal grain size number or the crystal grain size as described above.

As explained as above, the shadow mask of the present invention utilizes the iron-based alloy having a low-thermal expansion coefficient capable of being etched to form a predetermined shape, so that a uniformity in dimension of the through hole or slit can be further improved.

In addition, since the shadow mask hardly cause a thermal expansion in a Braun tube, the quality of the reproduced image displayed on the Braun tube can be increased and the shadow mask can be sufficiently applied to a high performance Braun tube.

In particular, in the case of forming a circular shape through hole, a circularity of the through hole can be improved. While, in the case of forming a slot shaped through hole or slit, the accuracy in dimension of a straight portion of the opening portion can be increased, so that the large hole portion facing to the surface side of the fluorescent material layer (fluorescent surface) formed to the Braun tube can be formed with high accuracy, and a pitch of the opening portions can be reduced. As a result, there can be manufactured a shadow mask having a sufficient strength capable of coping with a high performance (definition) Braun tube.

The shadow mask of the present invention is manufactured as follows.

At first, metal materials are blended so as to have a predetermined composition for an iron-based alloy, the blended materials are molten and solidified thereby to prepare a steel ingot. Then, the steel ingot is rolled in accordance with hot-forging method and/or hot-rolling method to thereby obtain an iron-based alloy plate having a predetermined thickness. Thereafter, the thus obtained iron-based alloy plate is further subjected to the cold-rolling and annealing processing or the like so as to prepare a plate member having a thickness of about 0.02–0.30 mm. The thus obtained plate member is then subjected to an etching treatment to thereby form a plate member for a shadow mask.

In this regard, the above etching treatment is a method comprising the steps of coating a photo-resist to the plate member and drying the coated resist, thereafter, exposing a light to the resist using a mask having a predetermined opening pattern of either a through hole pattern (circular-shape, slot-shape) or slit pattern so as to form a masked portions and non-masked portions, and etching-treating and melting the non-masked portions, thus forming a shadow mask (plate) member having a predetermined opening pattern.

The shadow mask member provided with the opening pattern having a circular-shape or slot-shape is formed by press-working so as to have a predetermined shape to thereby manufacture a press-type shadow mask.

On the other hand, the shadow mask member provided with the opening pattern having slits is welded and fixed to a steel frame at upper and lower portions thereof under a state that the steel frame is applied with a pressing force in a direction reverse to a direction for expanding the mask member. Thereafter, the pressing force is released, so that a high tensile force is imparted to the shadow mask member by the action of a restitutive force of the steel frame. At this time, the shadow mask member is expanded in a direction parallel to an extending direction of the slit so as to manufacture an expansion-type shadow mask.

Thereafter, these shadow masks are subjected to a surface-blackening treatment in which the shadow mask is heated in oxidizing atmospheres such as air atmosphere to a temperature of 500–700° C. for 5–20 minutes. The above surface-blackening treatment is conducted for the purpose of preventing the generation of secondary electron, heat-radiation, rust or the like, and can be provided an effect of increasing a corrosion resistance of the shadow mask.

EXAMPLES AND COMPARATIVE EXAMPLES

Hereunder, the present invention will be explained more concretely with reference to the following Examples and Comparative Examples.

Example 1

An iron-based alloy plate having a thickness of 0.12 mm was prepared from a material A having a composition shown in Table 1. A crystal grain size number of this iron-based alloy was measured in accordance with a grain-size-number measuring method prescribed in JIS G0551 (ASTM E112).

A crystal grain size in a cross section in a direction parallel or normal to the rolling direction of the iron-based alloy plate and an average crystal grain size in a cross section in a direction parallel to the rolling direction were measured in accordance with a method to be described hereinlater.

The obtained results are shown in Table 2. In this regard, factors of the respective crystal grains of the iron-based alloy plate were controlled by optimally combining various conditions such as a reduction ratio in the cold-rolling process, the annealing temperature and time at the annealing process conducted in the manufacturing processes for the shadow mask.

Then, a water-soluble casein photo-resist was coated on both the surfaces of the iron-based alloy plate, the coated resist was dried to thereby form resist films.

Thereafter, the resist films formed to both the surfaces of the iron-based alloy plate were exposed to perform patterning by using a pair of glass photographic dry plates which was a mask having a predetermined opening-pattern for forming the hole-pattern to the iron-based alloy plate. Subsequently, the patterned iron-based alloy was subjected to a hardening treatment and a baking treatment.

Then, ferric chloride solution as an etching solution having a temperature of 60° C. and a specific gravity of 48°

Be (heavy-Baume degree) was sprayed onto the patterned resist films formed to both the surfaces of the iron-based alloy plate so as to conduct etching work to the alloy plate to form the predetermined opening portions.

The etching solution was firstly sprayed to a surface side to which a small hole portion 4 (see FIG. 2) was to be formed to thereby actually form the small hole portion 4 having a predetermined size. Subsequently, an acid-resisting resin composed of paraffin, infrared ray-setting resin or the like was filled in the etched small hole portion 4 so as to cover the small hole portion 4. Then, as in the same manner, the etching solution was sprayed again onto another surface side to which a large hole portion 5 (see FIG. 2) was to be formed to actually form the large hole portion 5 having a predetermined size. The thus etched small hole portion 4 and the large hole portion 5 constituted a desired through hole.

After washing the etched plate member with water, the residual resist films were peeled and removed by an alkaline solution, thereafter washed and dried to thereby prepare a press-type shadow mask plate member formed with a number of through holes, each having a circular shape, that were formed to have a predetermined pattern.

Non-uniformity (color mismatching), shape-condition of opening hole, circularity, diameters of the respective holed portions, scattering in dimension of the through holes of the thus obtained shadow mask plate member were measured in accordance with methods to be described later on. The results are shown in Table 2.

At last, the thus obtained shadow mask plate member was press-formed to thereby manufacture a press-type shadow mask. The press-type shadow mask was assembled into a color Braun tube. The non-uniformity of the shadow mask was evaluated by confirming whether a color mismatching was caused or not on a reproduced image displayed on the Braun tube at the time when the shadow mask was used under actual operating conditions and thermal expansion was actually caused. The results are also shown in Table 2 together with other data.

Examples 2 and 3

Iron-based alloy plates each having a thickness of 0.12 mm were prepared from a material A having a composition shown in Table 1. However, these alloy plates were manufactured so that any of the crystal grain size number, the crystal grain size in a cross section in a direction parallel or normal to the rolling direction of the iron-based alloy plates and the average crystal grain size in a cross section in a direction parallel to the rolling direction were different from those of Example 1.

As a method of controlling the respective factors of crystal grains and a method of measuring the characteristics of the respective iron-based alloys and the mask plate members, same methods as used in Example 1 were conducted. The results are shown in Table 2.

Further, shadow mask plate members and press-type shadow masks were manufactured by the same method as used in Example 1, and characteristics of the respective shadow masks were measured and evaluated. The results are shown in Table 2.

Comparative Examples 1 and 2

Iron-based alloy plates each having a thickness of 0.12 mm were prepared from a material A having a composition shown in Table 1. However, these alloy plates were manufactured so that any of the crystal grain size number, the crystal grain size in a cross section in a direction parallel or normal to the rolling direction of the iron-based alloy plates and the average crystal grain size in a cross section in a direction parallel to the rolling direction were different from those of Example 1.

As a method of controlling the respective factors of the respective iron-based alloys and the method of measuring the characteristics of the respective iron-based alloys and the mask plate members, the same methods as used in Example 1 were conducted, The results are shown in Table 2.

Further, shadow mask plate members and press-type shadow masks were manufactured by the same method as used in Example 1, and characteristics of the respective shadow masks were measured and evaluated. The results are shown in Table 2.

TABLE 1

| Material | C | Ni | Co | Si | Mn | P | S | Bal. |
|---|---|---|---|---|---|---|---|---|
| A | 0.003 | 32.0 | 5.0 | 0.02 | 0.30 | 0.006 | 0.002 | Fe, Impurities |

TABLE 2

| | Iron-Based Alloy Plate | | | Shadow Mask Plate Member | | | | | | |
|---|---|---|---|---|---|---|---|---|---|---|
| | Crystal Grain Size Number | Crystal Grain Size (μm) | Average Grain Size (μm) | Non-uniformity | Opening Hole Shape-Condition | Circularity (%) | Diameter Large Hole Portion (μm) | Diameter of Small Hole Portion (μm) | Diameter of Through Hole (μm) | Scattering (μm) |
| Example 1 | 11.0 | 37 | 23.0 | Good | Good | 99.0 | 243.0 | 129.3 | 127.5 | 0.51 |
| Example 2 | 10.0 | 40 | 20.3 | Good | Good | 98.7 | 243.3 | 129.3 | 127.5 | 0.54 |
| Example 3 | 12.0 | 32 | 26.5 | Good | Good | 99.2 | 242.8 | 129.0 | 127.5 | 0.49 |
| Comparative Example 1 | 9.5 | 53 | 43.0 | Bad | Contour was waved | 96.0 | 247.3 | 132.1 | 127.4 | 0.90 |
| Comparative Example 2 | 10.0 | 53 | 31.2 | Bad | Contour was waved | 97.7 | 245.8 | 131.7 | 127.3 | 0.84 |

Measuring Method and Evaluation Results (1) Crystal Grain Size Number:

The crystal grain size number was measured in accordance with a grain-size-number measuring method prescribed in JIS G0551 (ASTM E112).

(2) Crystal Grain Size in Cross Sections in Directions Parallel and Normal to the Rolling Direction:

A ground glass to which circles respectively having diameters of 20 μm, 30 μm, 40 μm and 50 μm were drawn was disposed on a sample for measuring the crystal grain size number, and the sample was observed by a microscope with a magnification of 200–500 times.

Figure 3A:
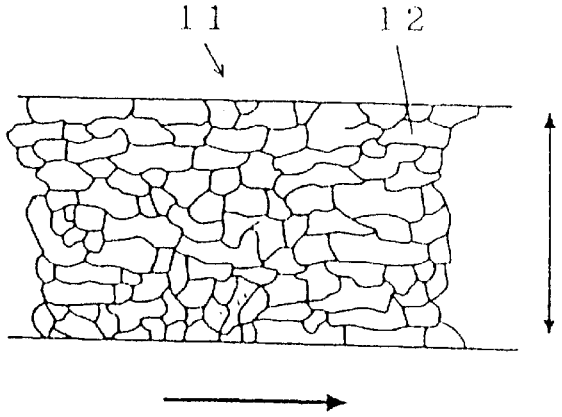
FIG. 3A is a cross sectional view of a crystal grain structure.
Figure 3B:
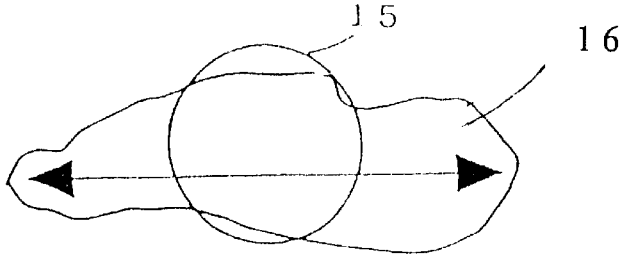
FIG. 3B is an explanatory view showing a method of measuring a crystal grain size existing in a cross section which is revealed in a direction parallel or normal to a rolling direction of the shadow mask.

As shown in FIG. 3B, the largest crystal grain 16, as a measuring object, was selected. Then, at first, the ground glass with the circle having a diameter of 50 μm was placed on a center portion of the largest crystal grain 16. Under this condition, it was confirmed whether at least two regions of the crystal grain projecting from the circle 15 or not. In the case where at least two regions, each projecting from the circle 15, existed, a straight line connecting any two points on the crystal grain boundary of each of the projecting regions was drawn, and a length of the straight line having the longest length was defined as a crystal grain size used in the present invention.

By the way, in the case where at least tow regions each projecting from the circle did not exist, another circle having a smaller diameter of 40 μm, 30 μm or 20 μm drawn on the ground glass was subsequently placed on the crystal grain in this order of diameters until at least two projecting regions were revealed. Under this condition, the same measuring operation was repeated so as to measure the crystal grain size. In this connection, FIG. 3(A) shows a crystal grain structure 11 revealed on a cross section in the thickness direction 14 normal to the rolling direction 13 of the crystal grain 12.

(3) Average Crystal Grain Size of a Cross Section in a Direction Parallel to the Rolling Direction:

The average crystal grain size was calculated based on the following equation:

$$\text{Average Crystal Grain Size of a cross section in a direction parallel to the rolling direction} = d \times N_1/N_2$$

wherein d denotes an average crystal grain size, and d was calculated in such a manner that the shape of the crystal grain measured by the crystal grain size number measuring method (JIS G0551) explained hereinbefore was assumed to be a square, and a length of one side of the square was deemed to be an average crystal grain size, and the average crystal grain size was calculated from a square root of an average sectional area of the measured crystal grain.

In addition, $N_1$ denotes the number of the crystal grains arranging in a thickness direction or a width direction and intersecting a line segment having a predetermined length (for example, 50 mm) set on a cross section parallel to the rolling direction of the iron-based alloy plate. Further, $N_2$ denotes the number of the crystal grains arranging in the rolling direction and intersecting a line segment having the same length as specified in $N_1$, the line segment was set on a cross section parallel to the rolling direction of the iron-based alloy plate. The $N_1$ and $N_2$ were calculated in such a manner that a sample of which crystal grain size number had been already measured was used, and $N_1$ and $N_2$ were repeatedly measured with respect to at least five visual views set on one sample. Each of $N_1$ and $N_2$ was calculated by averaging at least five measured values.

(4) Unevenness:

The unevenness (non-uniformity) was evaluated in such a manner that a light was irradiated to a shadow mask plate member from a side to which small hole portions of the through holes were formed, and the light passing through the through holes was observed through a visual check, thus evaluating the unevenness in dimensions of the through holes.

(5) Shape of Opening Portion:

The shape condition of the opening portion (through hole) was evaluated in such a manner that a piece of a sample including the through holes was cut out from each of the respective shadow mask plate members, and the sample was then observed by means of a scanning-type electron microscope, thus evaluating the shape condition of the through holes.

(6) Circularity of Through Hole:

The circularity (roundness) of the opening portion (through hole) was measured as follows. Namely, with respect to one through hole formed to each of the shadow mask plate members, a diameter of the through hole was repeatedly measured by changing a measuring angle so as to obtain at least five measured values of the diameter. Then, both the maximum and minimum values were selected from the all the measured values. By using the maximum and minimum values, the circularity of one through hole was calculated in accordance with the following equation:

$$\text{Circularity (\%)} = (\text{Minimum/Value Maximum Value}) \times 100$$

The circularity was repeatedly measured with respect to at least five different through holes formed to the same shadow mask plate member. The circularity of the through hole was evaluated by an average value obtained by averaging at least five measured values.

(7) Scattering of Through Hole:

The scattering value of the opening portions (through holes) was measured as follows. Namely, with respect to adjacent 25 (twenty-five) through holes formed to the respective shadow mask plate members, a diameter of the through hole was respectively measured so as to obtain a scattering value in the diameters of the through holes. In general, if the scattering value of the respective through holes is 0.8 μm or more, the shadow mask plate member is deemed to be a defective product, while if the scattering value is less than 0.8 μm, the shadow mask plate member is deemed to be an acceptably good product. [Results]

As is clear from the results shown in Table 2, each of Examples 1–3 was found to be free from the unevenness (non-uniformity) and had opening holes each having a good shape, an excellent circularity and a high strength. Accordingly, there could be obtained a shadow mask plate member of which the large hole portion was not excessively expanded and which had a required small diameter. Further, the manufactured shadow mask could reproduce and display a high quality image when the shadow mask was operated in a Braun tube under actual operating conditions.

On the other hand, Comparative Examples 1 and 2 were found to have unevenness and there was provided a shadow mask inferior in shape of the opening hole and dimensional accuracy.

As explained above, according to the present invention, the shadow mask has a crystal structure composed of fine crystal grains of which size is strictly specified, so that an etching operation can be performed with a high accuracy at a time of manufacturing the shadow mask whereby the shadow mask for a color Braun tube being free from the unevenness and having opening portions of which shape is improved can be effectively manufactured.

In addition, an excessive advancement of etching the large hole portions can be prevented, so that a lowering of the pitch between the adjacent opening portions can be realized for achieving a high-definition (performance) Braun tube and the lowering of the strength of the shadow mask can be effectively prevented.

Furthermore, the Braun tube provided with the shadow mask obtained by the present invention can sufficiently cope with a trend to a high-definition Braun tube, and a quality of the image displayed on the Braun tube can be further improved.

It is to be noted that the present invention is not limited to the described embodiments and many other changes and modifications may be made within the scope of the appended claims.

What is claimed is:

1. A shadow mask composed of an iron-based alloy plate containing 31.0–38.0 weight % of nickel and 1.0–6.5 weight % of cobalt, wherein said iron-based alloy has a crystal grain size number of 10 or more and 12 or less, has a crystal grain size of 50 $\mu$m or less in a cross section in a direction parallel and normal to a rolling direction of the iron-based alloy plate, and has an average crystal grain size of 30 $\mu$m or less in a cross section in a direction parallel to the rolling direction of the iron-based alloy plate.

2. A shadow mask according to claim 1, wherein said iron-based alloy has a thermal expansion coefficient of approximately $4.0\times10^{-6}$/° C.

3. A shadow mask for a Braun tube comprising:

a frame member;

a mask body in shape of plate made of an iron-based alloy material; and an opening portion formed to the mask body, wherein the iron-based alloy material contains 31.0–38.0 weight % of nickel and 1.0–6.5 weight % of cobalt, the iron-based alloy has a crystal grain size number of 10 or more and 12 or less, has a crystal grain size of 50 $\mu$m or less in a cross section in a direction parallel and normal to a rolling direction of the iron-based alloy, and has an average crystal grain size of 30 $\mu$m or less in a cross section in a direction parallel to the rolling direction of the iron-based alloy.

* * * * *